US006509817B2

(12) United States Patent
Kaneko et al.

(10) Patent No.: US 6,509,817 B2
(45) Date of Patent: Jan. 21, 2003

(54) MULTIPOLAR CIRCUIT BREAKER

(75) Inventors: Shozo Kaneko, Izumi; Yukihiko Asao, Sakai; Yoshiaki Kagari, Yao, all of (JP)

(73) Assignee: Terasaki Denki Sangyo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/984,367

(22) Filed: Oct. 30, 2001

(65) Prior Publication Data

US 2002/0050892 A1 May 2, 2002

(30) Foreign Application Priority Data

Oct. 31, 2000 (JP) ..... 2000-332216

(51) Int. Cl.[7] ..... H01H 75/00; H01H 33/08

(52) U.S. Cl. ..... 335/201; 335/6; 335/8; 218/155; 218/156

(58) Field of Search ..... 335/6, 8, 15, 16, 335/201; 218/155, 152, 156

(56) References Cited

U.S. PATENT DOCUMENTS 3,394,329 A 7/1968 Heft
4,117,285 A 9/1978 Harper
4,935,589 A * 6/1990 Kohanawa ..... 218/152

FOREIGN PATENT DOCUMENTS

| | | |
|---|---|---|
| DE | 3840940 | 6/1989 |
| EP | 0 309 386 | 3/1989 |
| JP | 63-119126 | 5/1988 |

* cited by examiner

*Primary Examiner*—Ramon M. Barrera
(74) *Attorney, Agent, or Firm*—McDermott, Will & Emery

(57) ABSTRACT

A multipolar circuit breaker of great breaking capacity prevents arc gas from blowing out from the side at the time of cutting off a short-circuit current. A stationary contact and a movable contact generating arcs when a short-circuit current is cut off, and an arc extinguisher extinguishing the arc are stored in an arc extinguisher casing. By forming the ceiling, the bottom and the sidewalls connecting the ceiling and the bottom of the arc extinguisher casing in continuity so that no gap is formed by an outward internal pressure, blow out of arc gas from the sidewall portion is suppressed.

18 Claims, 20 Drawing Sheets

MULTIPOLAR CIRCUIT BREAKER

BACKGROUND OF THE INVENTION

1. Field of the Invention

The present invention relates to a multipolar circuit breaker having a synthetic resin mold insulative casing.

2. Description of the Background Art

A circuit breaker has switch contacts, a switch mechanism operating the switch contact, a tripping mechanism operating when overcurrent flows to separate the switch contact via the switch mechanism, an arc extinguisher and the like disposed within a synthetic resin mold insulative casing.

An example of a conventional circuit breaker is disclosed in Japanese Patent Laying-Open No. 63-119126. FIG. 23 is a sectional view of this circuit breaker, viewed from the side. In the casing formed of a synthetic resin mold insulative base 100 and a synthetic resin mold insulative cover 101 coupled to each other through a screw are provided a main circuit conductor including a stationary switch contact 102 also serving as a terminal base, a movable switch contact 103, a flexible conductor 104, a unit conductor 105 in a trip unit 109 that will be described afterwards, and a terminal base 106. Also, a switch mechanism 107 operating movable switch contact 103, a trip unit 109 operating when overcurrent flows to release the engagement of a latch mechanism 108 to separate movable switch contact 103 from stationary switch contact 102 via the switch mechanism, and an arc extinguisher 110 are provided in the casing.

In such a conventional circuit breaker, there is a limit in the strength and tightening force of the screw that couples the base and cover together. Arc gas of high pressure generated when the circuit breaker cuts off a great short-circuit current will form a gap at the abutting face between the base and cover. The arc gas blows out through this gap at the side of the circuit breaker. There was a problem that the breaking capacity could not be increased.

This conventional circuit breaker must have a robust overall casing since the arc gas will spread entirely within the casing. There was also the problem that the conventional circuit breaker was increased in size and cost since the trip unit must be accommodated in the casing.

SUMMARY OF THE INVENTION

An object of the present invention is to provide a multipolar circuit breaker of large breaking capacity without arc gas blowing out from the sidewall.

Another object of the present invention is to provide a compact and inexpensive multipolar circuit breaker.

According to an aspect of the present invention, a multipolar circuit breaker includes a switch contact, an arc extinguisher, an input terminal, an output terminal, and an overcurrent tripping device for each pole. The multipolar circuit breaker includes a switch mechanism to operate the switch contact, and a trip mechanism to separate the switch contact through the switch mechanism in the operation of the overcurrent tripping device, common to each pole. The multipolar circuit breaker includes an arc extinguisher casing having a ceiling portion, a bottom portion and a sidewall joining the ceiling portion and the bottom portion and formed in continuity so that no gap is generated by an outward internal pressure. The switch contact and an arc extinguisher for each pole are stored in a separated manner from the counterpart of a neighbor pole by a partition wall separating respective poles, located parallel to the sidewall of the arc extinguisher casing.

Since the ceiling portion, bottom portion and sidewall of the arc extinguisher casing are formed continuously, absent of an abutting portion, arc gas will not blow out from the side of the circuit breaker. The configuration of the above-mentioned portion of the arc extinguisher casing being formed so that no gap is generated by the internal pressure includes the case where the members are formed integrally in continuity by integralmolding as well as the case where members are overlapped on each other to avoid formation of an abutting portion. The latter case includes the layering of another sheet-like member from the inner side of the abutting portion to prevent gap generation. The separation by the partition wall will prevent the arc gas, when generated at one pole, from affecting the other poles. The arc extinguisher casing is preferably a synthetic resin mold insulator having a rectangular cross section.

In the multipolar circuit breaker of the present aspect, the portion of at least the ceiling portion, bottom portion and the sidewall of the arc extinguisher casing can be formed in one piece by integral-molding. Therefore, fabrication thereof is simple.

In the multipolar circuit breaker of the present aspect, the arc extinguisher casing includes an upper member having the ceiling portion and the portion of the sidewall located at the ceiling side formed in one piece by integral-molding, and a lower member having the bottom portion and the portion of the sidewall located at the bottom side formed in one piece by integral-molding. Also, the portion of the sidewall of the upper member can be overlapped with the portion of the sidewall of the lower member. The sidewall formed by two sidewalls is absent of an abutting portion. Therefore, arc gas will not blow out at the side of the circuit breaker.

In the multipolar circuit breaker of the present aspect, the switch mechanism can be provided on the outer surface of the arc extinguisher casing. Therefore, the robust arc extinguisher casing that must withstand arc gas can be limited to the size that can store the switch contact and the arc extinguisher.

The multipolar circuit breaker of the present invention includes a switch unit with a switch contact, an arc extinguisher, an arc extinguisher casing, and a switch mechanism; a trip unit having an overcurrent tripping device stored in a synthetic resin mold insulative trip unit casing; and a synthetic resin mold insulative cover enclosing the switch unit and the trip unit.

By such a structure, a circuit breaker can be fabricated easily by assembling a switch unit and an overcurrent trip unit individually and then coupling both units with each other. Therefore, in the case where there are compatible units of a plurality of types due to difference in the rated current or the like, exchange is allowed even after the two units have been coupled. Also, only the arc extinguisher casing requires strength to withstand the arc gas, and the trip unit casing and cover may be of lower strength. Furthermore, a molded component that can entirely accommodate the arc extinguisher casing, switch mechanism and the trip unit casing is not required, so that the entire dimension can be reduced.

In the multipolar circuit breaker of the present invention, the synthetic resin mold insulative cover includes a ceiling portion that is substantially rectangular when viewed in plan, and a sidewall extending from the four sides of the ceiling portion and being in close contact with the arc extinguisher casing and trip unit casing in parallel. By virtue of this structure, the coupling of the two units is enhanced by the cover.

In the multipolar circuit breaker of the present invention, any one of a convex portion and a concave portion that are both engageable with the other counterpart is formed at respective sidewalls of the arc extinguisher casing and trip unit casing, whereas the other engageable counterparts of the convex portion or the concave portion are formed at least one pair of sidewalls opposite to each other of the synthetic resin mold insulative cover. By this structure, a screw to attach the cover is not required.

In the multipolar circuit breaker of the present invention, the connection portion of the main circuit conductor included in the switch unit and the trip unit can include a screw that is screwed in from the back side of the circuit breaker. By this structure, the space to attach the screwing tool at the surface side of the coupling portion is dispensable. This provides a margin in the structure of the switch mechanism and the trip mechanism.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
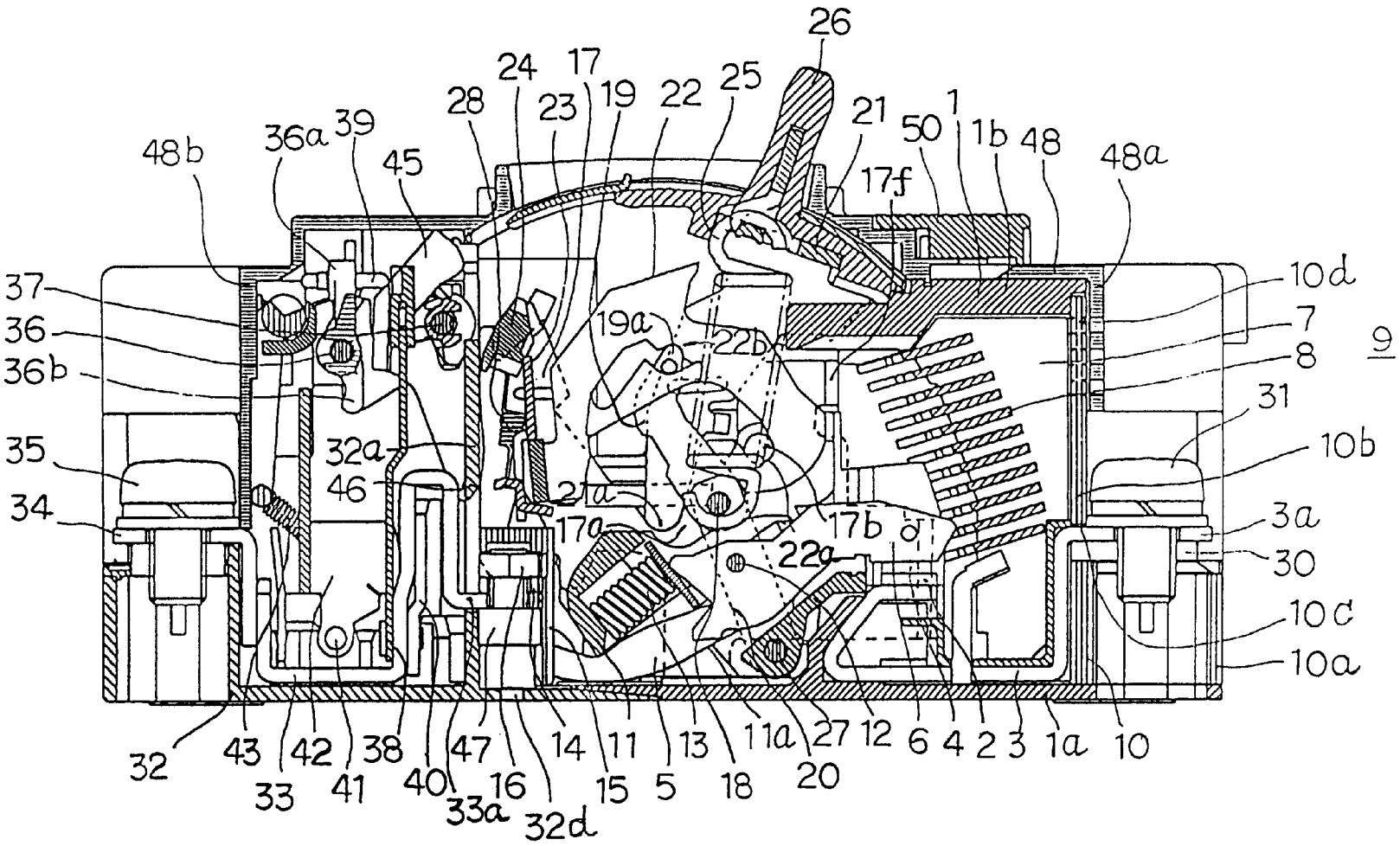
FIG. 1 is a side sectional view of a circuit breaker according to an embodiment of the present invention.
Figure 2:
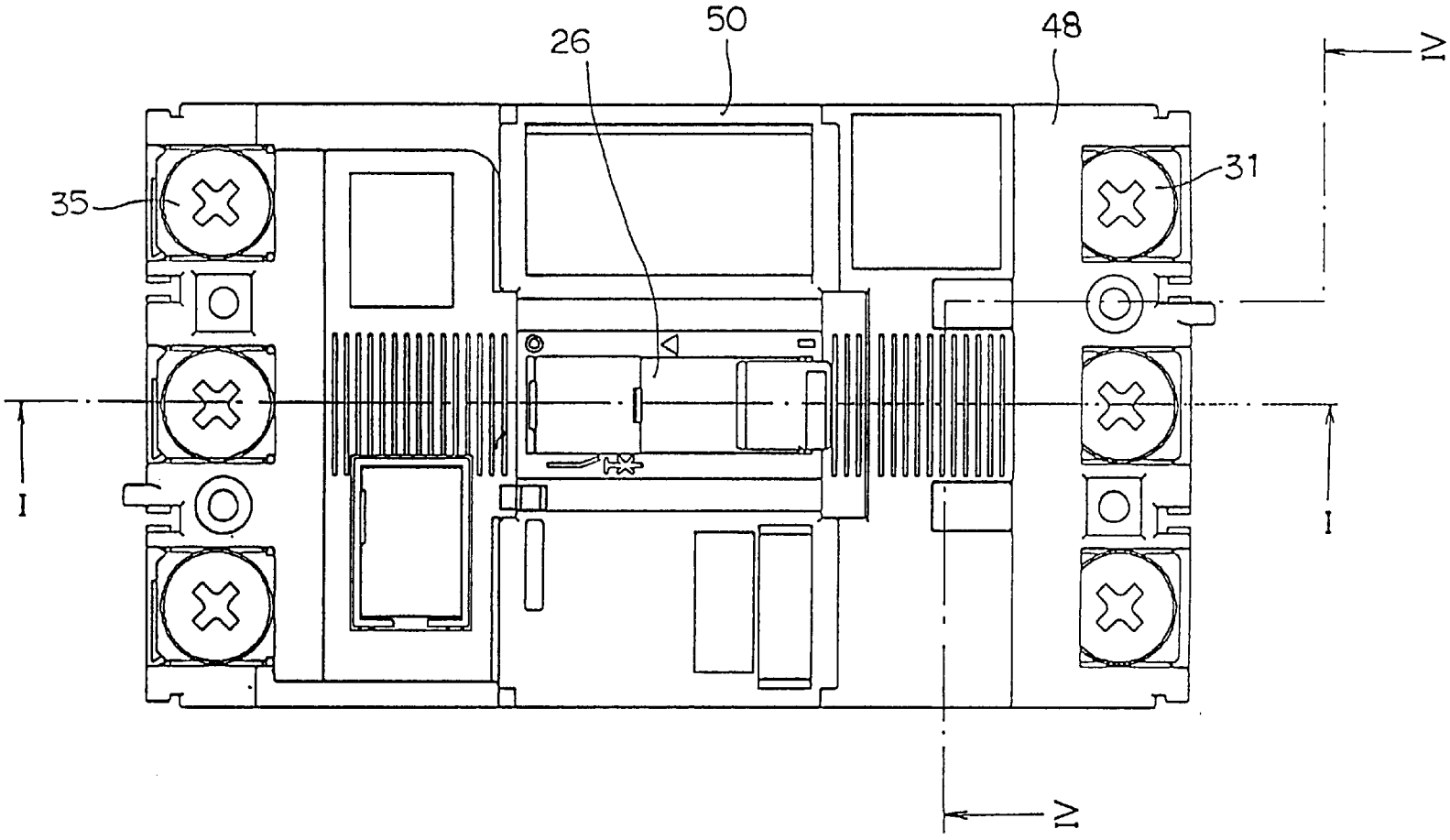
FIG. 2 is a front view of the appearance of the circuit breaker of FIG. 1.
Figure 3:
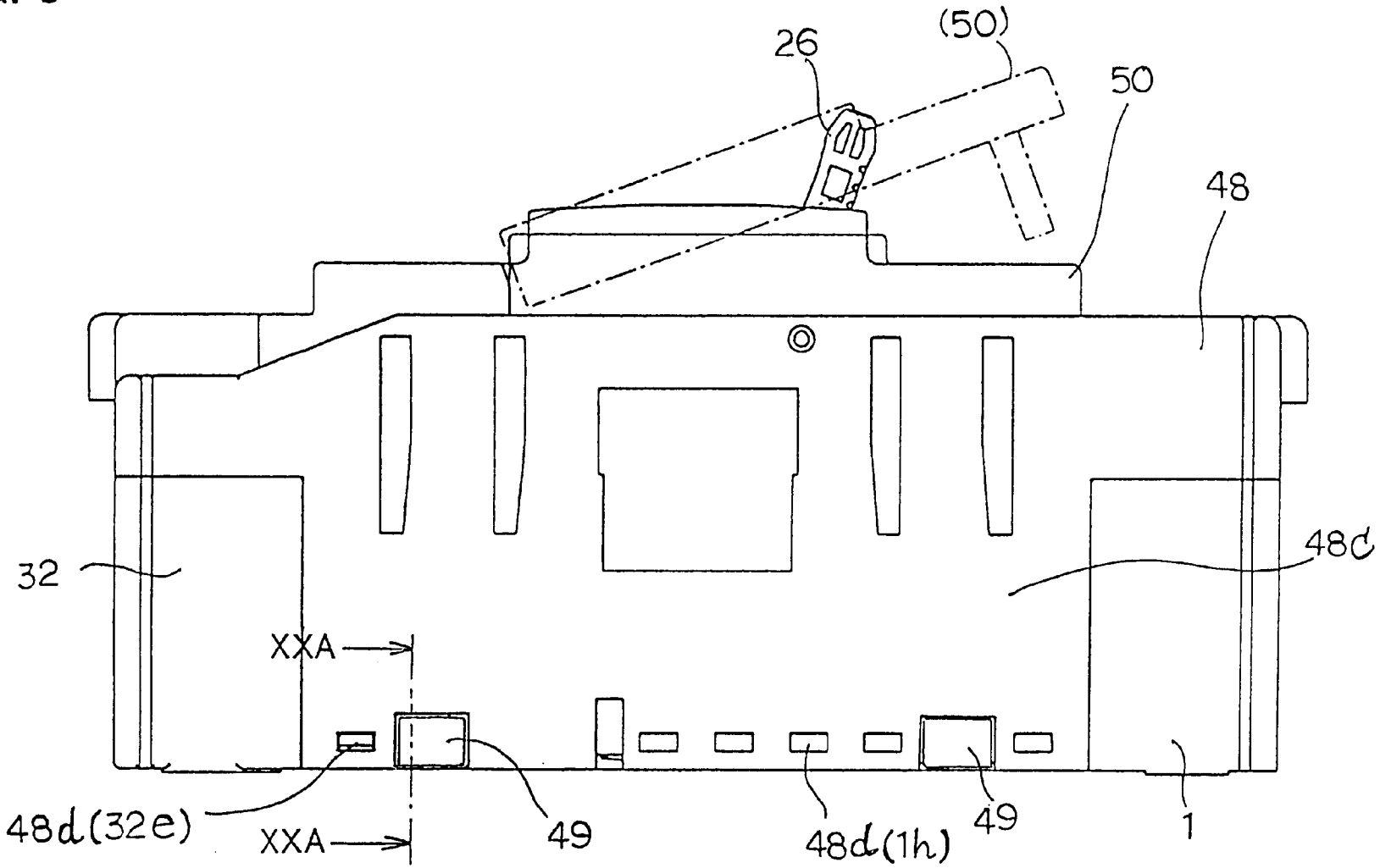
FIG. 3 is a side view of the appearance of the circuit breaker of FIG. 1.
Figure 4:
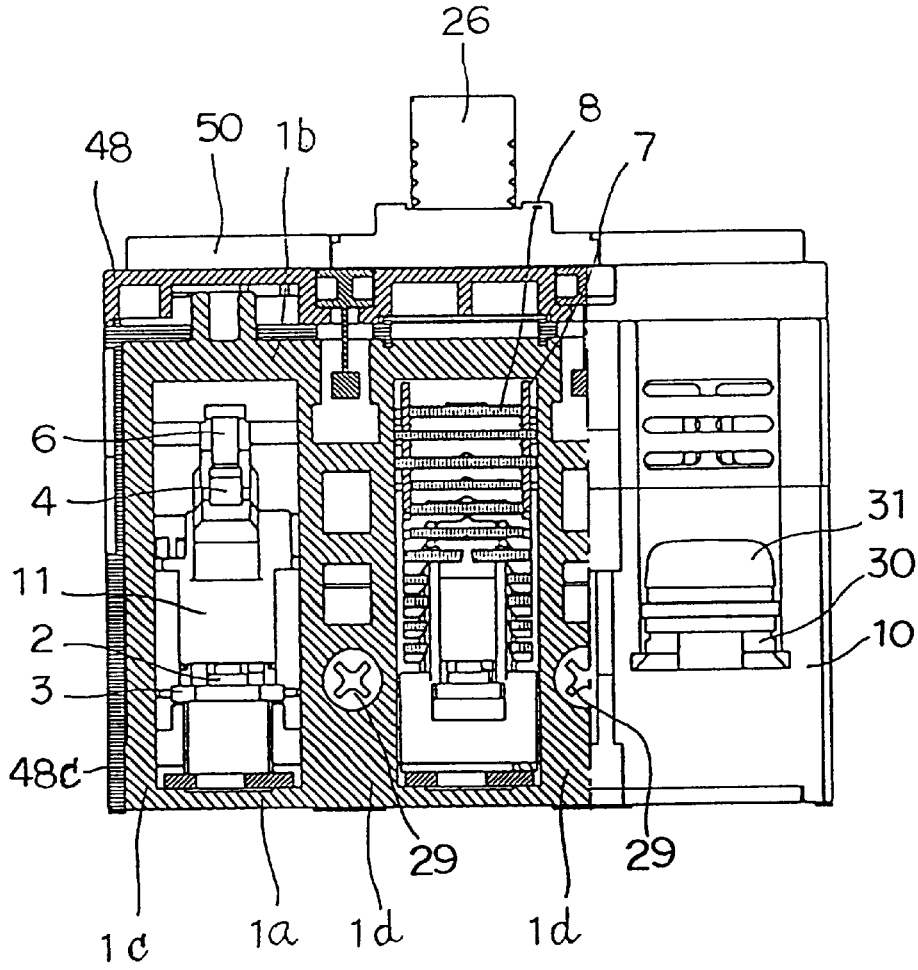
FIG. 4 is a partial sectional view of FIG. 2 taken along line IV—IV.

Embodiments of the present invention will be described hereinafter with reference to FIGS. 1–22. The circuit breaker according to the embodiment shown in FIGS. 1-20B is the 3-pole type, and includes a switch unit, a trip unit, and a cover enclosing the two units. FIG. 2 is a front view of the entire circuit breaker of the present embodiment. FIG. 1 is a sectional view of the circuit breaker of FIG. 2 taken along line I—I. FIG. 3 is a side view of the appearance of the circuit breaker of the present embodiment. FIG. 4 is a sectional view of the circuit breaker of FIG. 2 taken along line IV—IV, wherein for the sake of clarifying the drawing, the left pole does seemingly not have an arc extinguisher 9 that is actually contained in the left pole and will be described afterwards.

The switch unit is shown in FIGS. 1–14, and the structure thereof will be described mainly based on FIGS. 1, 4, 5, 6, 7, 12 and 14. The switch unit includes arc extinguisher casing 1 molded from insulative synthetic resin, a switch contact disposed in arc extinguisher casing 1, an arc extinguisher stored in arc extinguisher casing 1, and a switch mechanism provided at the outer side of arc extinguisher casing 1.

Arc extinguisher casing 1 has a bottom 1*a*, a ceiling 1*b*, sidewalls 1*c* and two partition walls 1*d* formed by integral-molding. Arc extinguisher casing 1, when viewed from the side, has a configuration in which the left portion of the ceiling is low and the middle portion becomes gradually higher so that the right side portion is higher. The two partition walls 1*d* disposed vertically divide the middle portion and the right side portion into three rooms. In each room are provided a stationary contact 3 with a contact tip 2 and a terminal portion 3*a* at respective ends, a movable contact 6 with a contact tip 4 and a flexible lead 5 at respective ends, and an arc extinguisher 9 having a plurality of magnetic steel plates 8 held by an insulation plate 7. The opening at the right side of each room is closed by a synthetic resin mold insulative terminal base 10 mounted on a plane extending from bottom 1*a* of arc extinguisher casing 1. Terminal base 10 includes a block portion 10*a* supporting terminal portion 3a of stationary contact 3 and a wall portion 10*b*. A terminal through hole 10*c* and a vent hole 10*d* are formed in wall portion 10*b*.

Movable contact 6 is held on an arm 11*a* of a synthetic resin mold insulative cross bar 11, common to the 3 poles, in a rotatable manner by a shaft 12, and urged clockwise by a spring 13 provided between the walls of cross bar 11 and movable contact 6. The other end of flexible lead 5 is connected to a lead terminal 14. A lead terminal base 15 accommodating lead terminal 14 of each pole is formed of a synthetic resin mold insulator. A hexagonal dent into which a nut 16 is fitted is formed at the region where lead terminal 14 is to be disposed. Cross bar 11 has a columnar support 11*b* at both ends. Support 11*b* is fitted between a U-shaped groove 1*e* formed in both sidewalls 1*c* of arc extinguisher casing 1 and the concave formed in lead terminal base 15 to support cross bar 11 in a rotatable manner.

The inclination of the ceiling at the middle portion of arc extinguisher casing 1, when viewed from the side, corresponds to the rotation angle of movable contact 6 and cross bar 11. The height of the ceiling at the right side is set as low as possible while ensuring the current breaking performance (in the present embodiment, the lowest height allowing storage of arc extinguisher 9) to minimize the size of arc extinguisher casing 1.

The switch mechanism to rotate cross bar 11 is built on a pair of frames 17 provided along the two sidewalls of arc extinguisher casing 1 at the middle pole area. The switch mechanism employs the toggle link mechanism. Specifically, the switch mechanism includes a pair of links 19 and 20 connected to each other in a rotatable manner by a shaft 18. The switch mechanism also includes a handle lever 21, a trip lever 22, a hook 23 to prevent the clockwise rotation of trip lever 22, and a latch 24 preventing the counter clockwise rotation of hook 23, all provided on frame 17 in a rotatable manner. The switch mechanism further includes a spring 25 provided between shaft 18 and handle lever 21, and a synthetic resin mold insulative handle 26 inserted at the horn of handle lever 21.

Handle lever 21 is formed in a bent manner having an angulated U-shape, so that both arms move within a plane identical to that of frame 17. An arcuated end 21*a* of the arm of handle lever 21 is urged towards a notch-like concave 17*a* formed in frame 17 by the force of spring 25. Trip lever 22 is formed in a bent manner having an angulated U-shape so that both arms move along a plane adjacent to the inner side of frame 17. A curl end 22*a* formed at the arm of trip lever 22 is fitted in a columnar projection 17*b* formed at the facing planes of the pair of frames 17. The pair of links 19 is arranged to move within a plane identical to that of the arm of trip lever 22. An arcuated end 19*a* of link 19 is urged against a notch-like concave 22*b* formed at both arms of trip lever 22 by the force of spring 25. The pair of links 20 is connected to cross bar 11 in a rotatable manner by a shaft 27.

Figure 12:
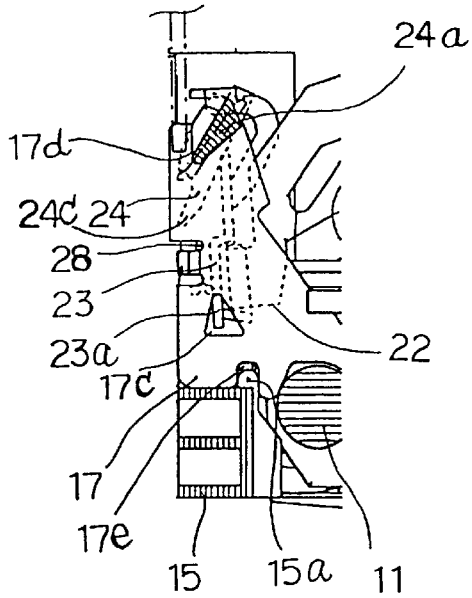
FIGS. 12 and 13 are partial side sectional views of the switch unit of the circuit breaker of FIG. 1 with different section line.

FIG. 12 shows a portion of this switch mechanism when viewed from outside the plane of frame 17. Hook 23 has both legs 23*a* disposed in a triangular hole 17*c* formed in frame 17. A latch 24 has both legs 24*a* disposed in a V-shaped notch 17*d* formed in frame 17. Hook 23 and latch 24 are urged clockwise and counterclockwise, respectively, by the force of spring 28.

Figure 5:
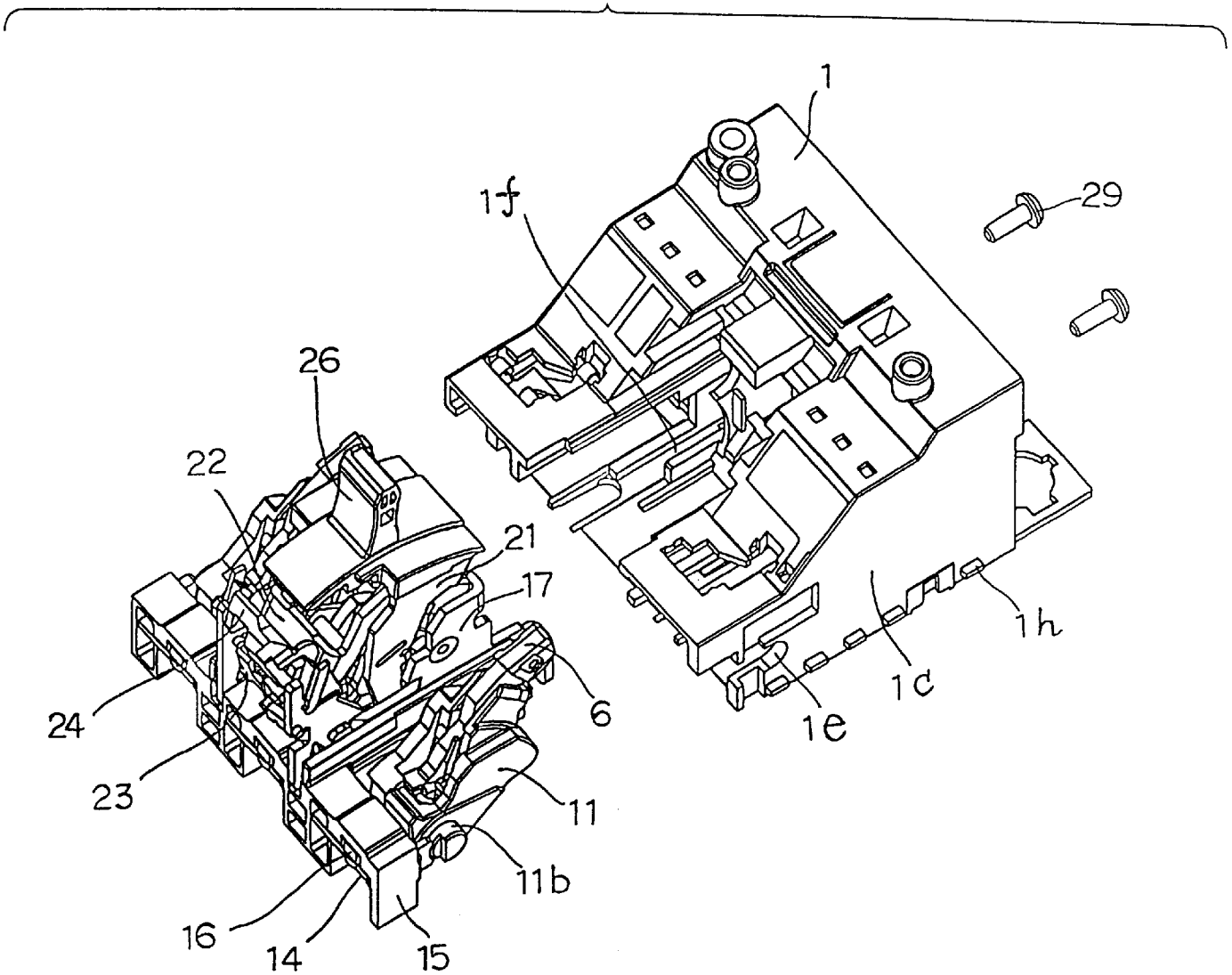
FIG. 5 is an exploded perspective view of the switch mechanism portion of the circuit breaker of FIG. 1.
Figure 6:
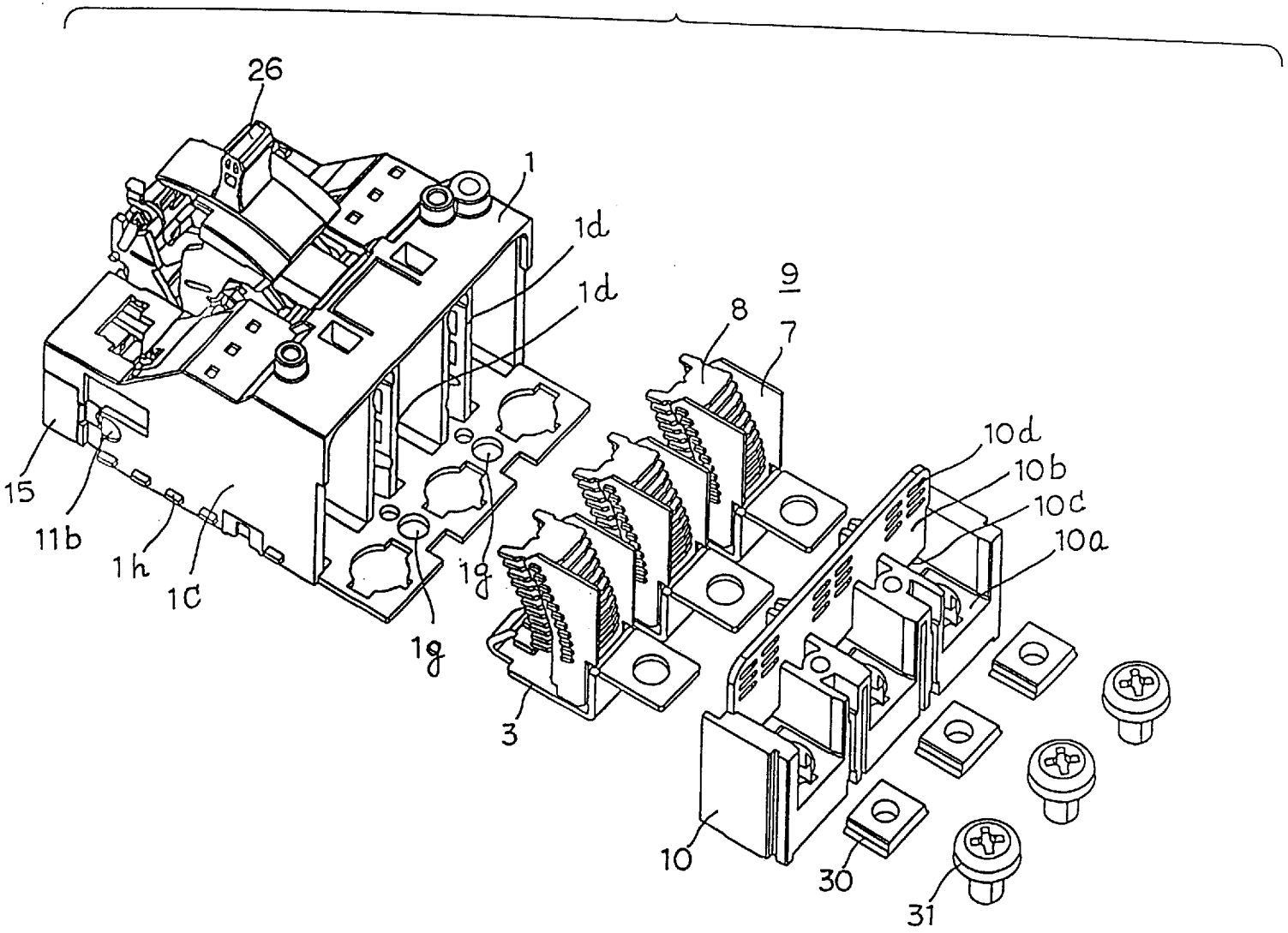
FIG. 6 is an exploded perspective view of the arc extinguisher portion of the circuit breaker of FIG. 1.

The switch unit is assembled as shown in FIGS. 5 and 6. Referring to FIG. 5, the above-described components of the switch mechanism are temporarily assembled on the pair of frames 17. Specifically, the components of the switch mechanism are attached to arc extinguisher casing 1 so that support 11*b* of cross bar 11 fits in a U-shaped groove 1*e* of arc extinguisher casing 1 and frame 17 fits in a groove if formed at both sides of arc extinguisher casing 1 at the middle pole region. At this stage, lead terminal base 15 has its projection 15*a* engaged with notch 17*e* in frame 17 to be securely fastened, as shown in FIG. 12. Frame 17 on which these components are temporarily assembled is fastened by means of a screw 29 through partition wall 1*d* of arc extinguisher casing 1.

Figure 7:
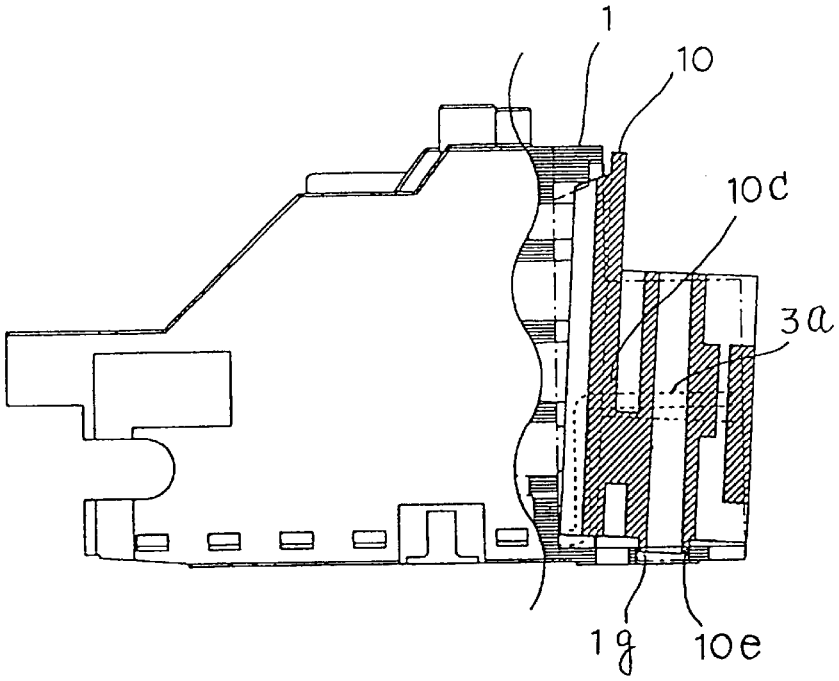
FIG. 7 is a diagram to describe the method of mounting a terminal base of the circuit breaker of FIG. 1.

Referring to FIG. 6, stationary contact 3 and arc extinguisher 9 of each pole are inserted from the right side of arc extinguisher casing 1. Terminal base 10 is mounted on an extending plane of bottom 1*a* of arc extinguisher casing 1. Specifically, terminal base 10 is mounted as set forth in the following. Referring to FIG. 7, terminal base 10 is slightly tilted and inserted so that projection 10*e* formed at the bottom of terminal base 10 fits into the two round holes 1*g* formed at the extending plane of arc extinguisher casing 1. Concurrently, terminal portion 3*a* of stationary contact 3 is inserted into terminal through hole 10*c*. Terminal base 10 is arranged vertically as indicated by the chain-dotted line and inserted into arc extinguisher casing 1. A terminal nut 30 is disposed between block portion 10*a* and terminal portion 3*a* to receive terminal screw 31. Projection 10*e* of terminal base 10 has a hole communicating upwards. The screw used to mount the circuit breaker of the present embodiment is screwed into this hole, whereby a cover 48 that will be described afterwards, terminal base 10 and arc extinguisher casing 1 are secured together.

Figure 13:
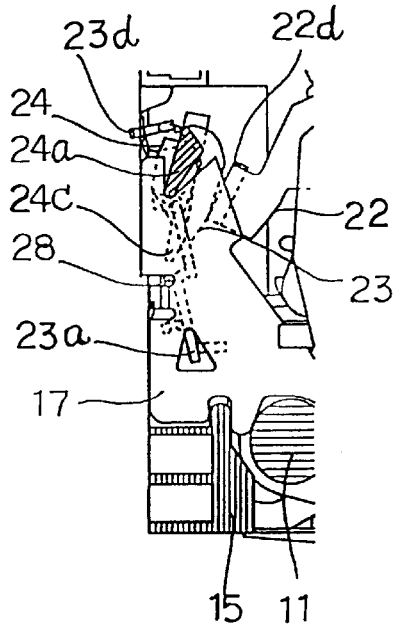
Figure 14:
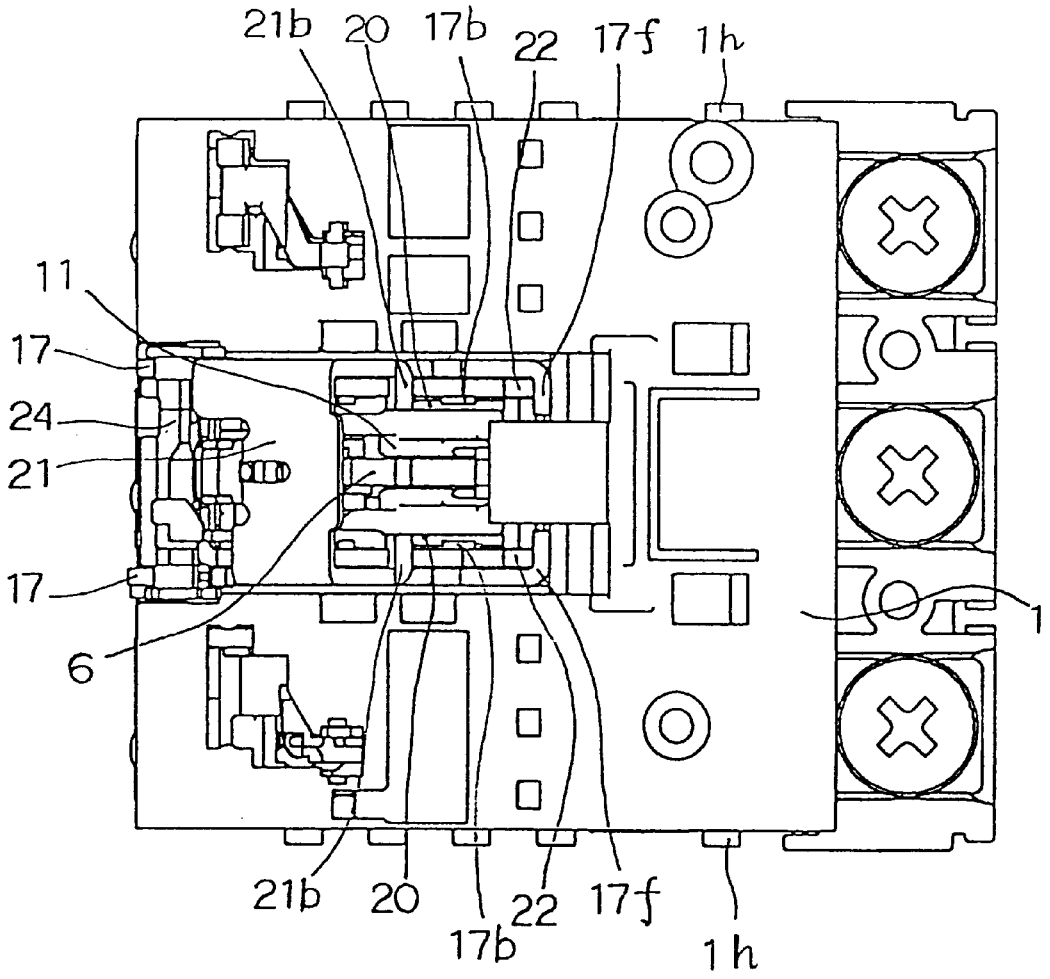
FIG. 14 is a front view of the circuit breaker of FIG. 1.

The switch unit of the above-described configuration independently enables itself to make the operation of opening, closing, tripping, and resetting, as will be described hereinafter. FIGS. 8, 9,10, and 11 are side sectional views of the switch unit corresponding to a closed state, an open state, a tripped state and a reset state, respectively. FIGS. 12 and 13 show sectional views of a portion of the switch unit, viewed from the outer side of the other front-side frame 17, corresponding to a closed state and a tripped state, respectively. FIG. 14 is a front view of the switch unit in an open state, absent of the illustration of handle 26.

Figure 8:
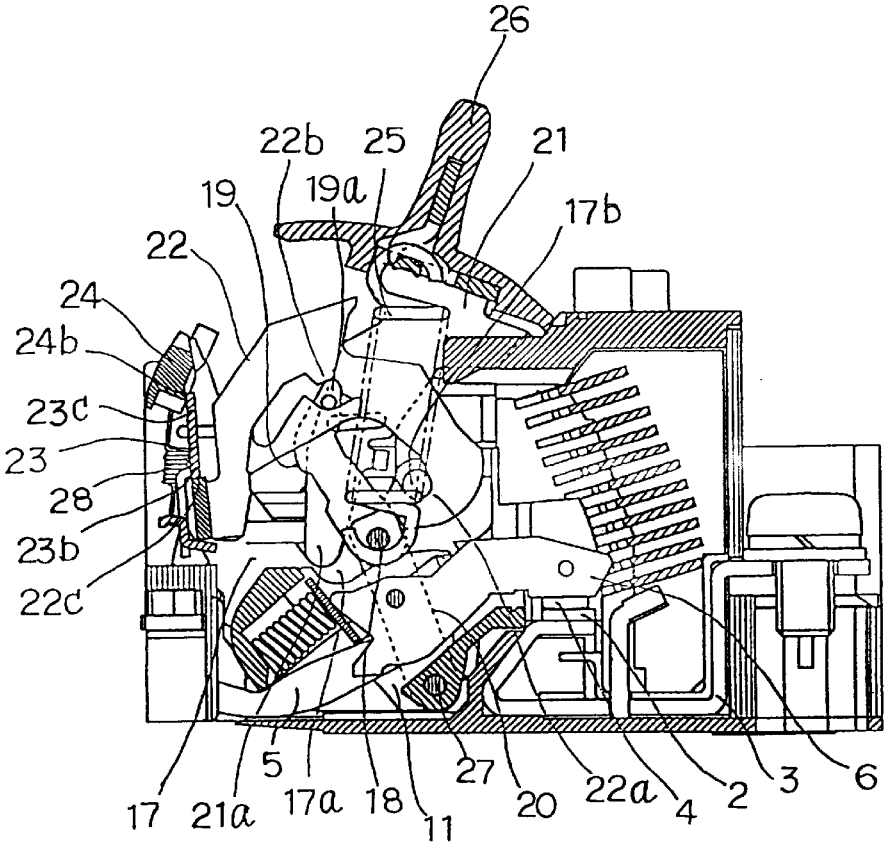
FIGS. 8 and 9 are side sectional views of the switch unit of the circuit breaker of FIG. 1 in a closed state and an open state, respectively.
Figure 9:
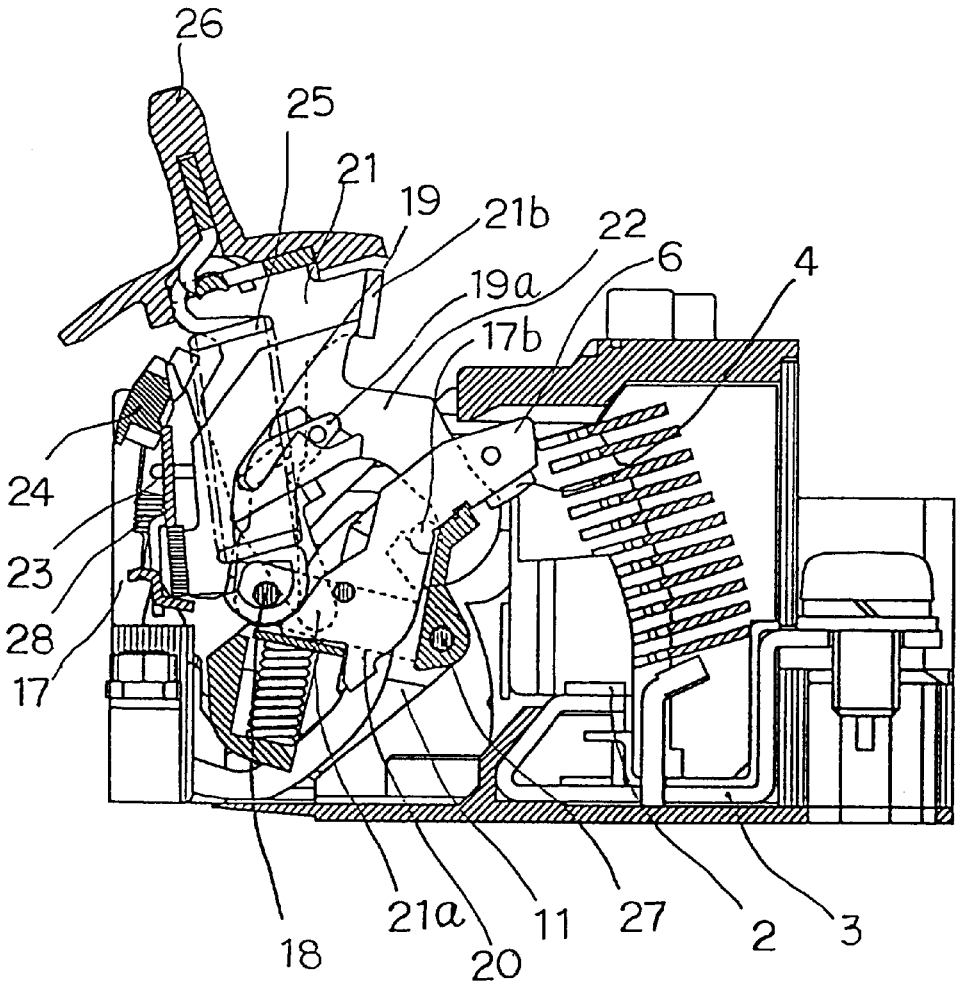
Figure 10:
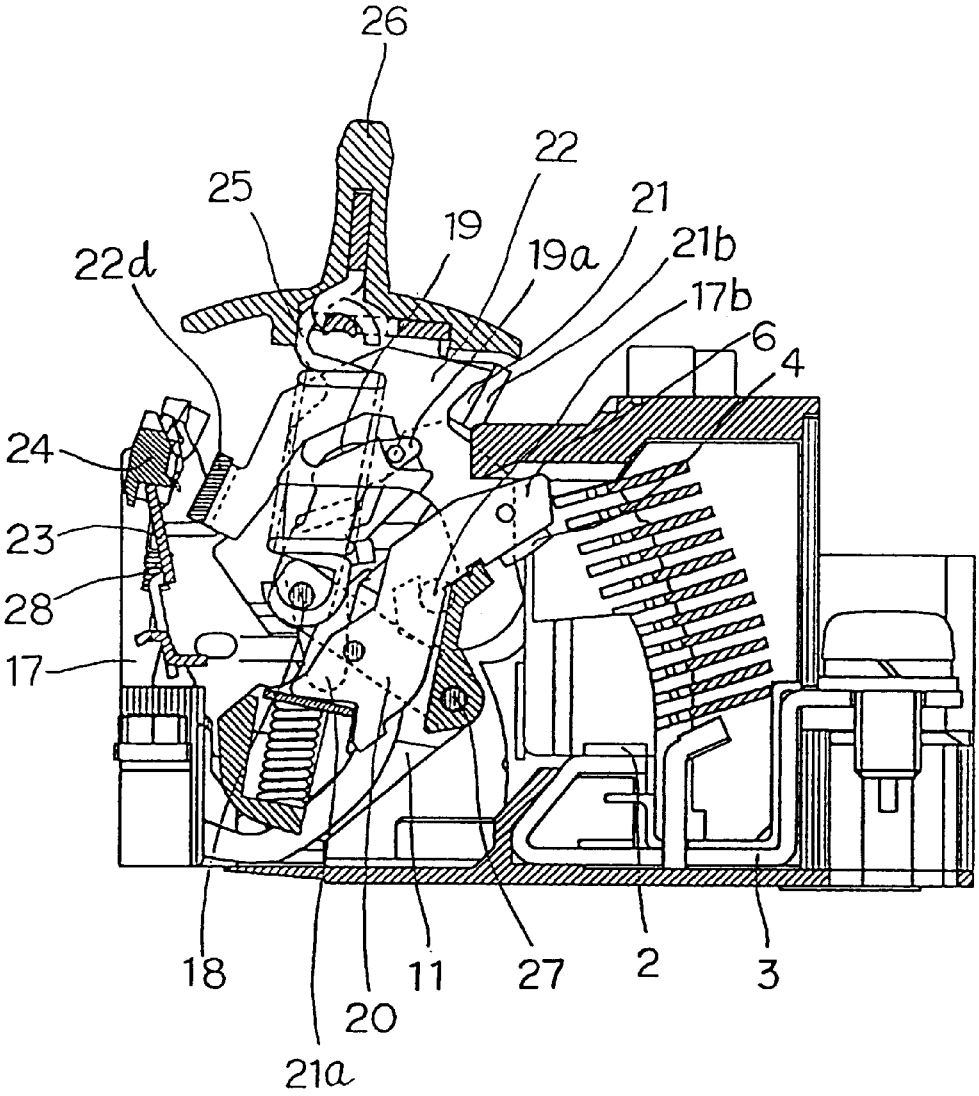
FIG. 10 is a side sectional view of the switch. unit of the circuit breaker of FIG. 1 in a tripped state.

In the closed state shown in FIG. 8, the rotation of handle lever 21 urged clockwise by the force of spring 25 about arcuated end portion 21*a* is blocked by the contact at the edge of frame 17. Trip lever 22 is urged clockwise about projection 17*b* of frame 17 through the force of spring 25 via shaft 18 and link 19. Trip lever 22 urges hook 23 counterclockwise against the force of spring 28 by the engagement of latch portion 22*c* and a latch receiving portion 23*b* of hook 23. This urge causes latch 24 clockwise against the force of spring 28 via latch portion 23*c* of hook 23 and latch receiving portion 24 of latch 24. Since the rotation of latch 24 is blocked by the V side of notch 17*d* of frame 17, the rotation of hook 23 and trip lever 23 are also blocked. Here, shaft 18 is urged rightwards by the force of spring 25. The lower end portion of link 19 abuts against curl end 22*a* of trip lever 22 to stop with link 20 and link 19 in a substantially straight stretching state. Contact is established between contacts 2 and 4 with cross bar 11 rotated clockwise.

The opening operation is effected by rotating handle 26 of the circuit breaker counterclockwise. This rotation causes the line of action of the force of spring 25 to be shifted from the right to left of arcuated end portion 19*a* of link 19, whereby shaft 18 moves leftward so that link 20 and link 19 take the arrangement of crossing in a bent manner. As a result, cross bar 11 rotates counterclockwise to open the contacts, and then comes into contact with a portion not shown of arc extinguisher casing 1 to be suppressed in rotation. Handle lever 21 has its bent portion 21*b* brought into contact with trip lever 2 to be blocked of rotation, attaining the open state of FIG. 9.

The close operation is effected by rotating handle 26 of the circuit breaker clockwise. This rotation causes the line of action of spring 25 to move from the left to right of arcuated end portion 19*a* of link 19, whereby shaft 18 moves rightward while links 19 and links 20 are arranged in a straight stretching manner. Therefore, cross bar 11 rotates clockwise to attain the closed state of FIG. 8.

The trip operation is realized by rotating latch 24 attaining a closed state counterclockwise. This rotation cancels the engagement between latch 24 and hook 23 and the engagement between hook 23 and trip lever 22. As a result, trip lever 22 rotates clockwise while pushing bent portion 21*b* of handle lever 21 until contact is established with bent portion 17*f* of frame 17 shown in FIG. 14. At this stage, links 19 and links 20 both move upwards while cross bar 11 rotates counterclockwise, whereby the contacts open. Then, cross bar 11 comes into contact with arc extinguisher casing 1 to attain the tripping state of FIGS. 10 and 13 where the rotation is suppressed.

The reset operation is effected by rotating handle 26 of the circuit breaker attaining a tripping state counterclockwise.

Figure 11:
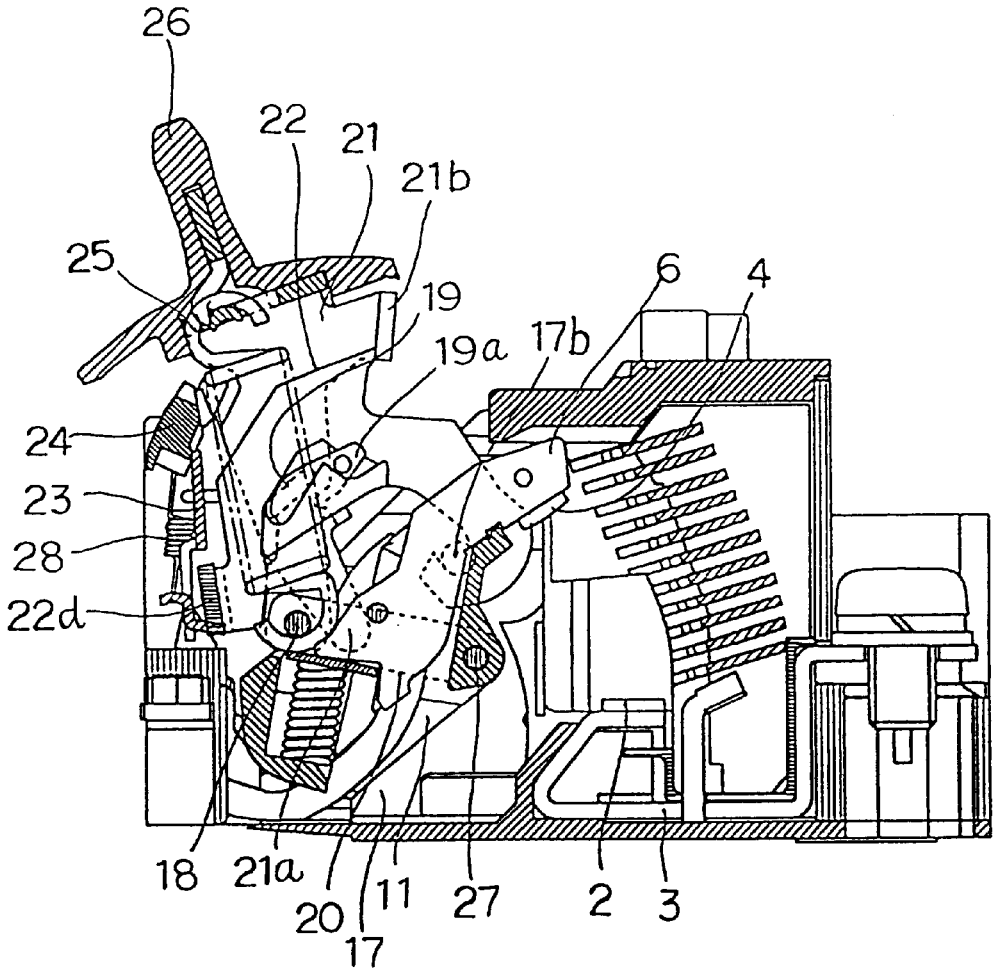
FIG. 11 is a side sectional view of the switch unit of the circuit breaker of FIG. 1 during a reset operation.

This rotation causes trip lever 22 to be rotated counterclockwise in response to the push of bent portion 21*b* of handle lever 21. Following the travel of a shoulder portion 22*d* of trip lever 22, hook 23 rotates clockwise and latch 24 rotates counterclockwise. As a result, the engageable state between trip lever 22 and hook 23 is established, as shown in FIG. 11. By freeing handle 26 under this state, engagement is established between trip lever 22 and hook 23 and between hook 23 and latch 24, attaining the open state of FIG. 9.

As shown mainly in FIG. 1 and FIGS. 15–18, the trip unit is provided in a synthetic resin mold insulative trip unit casing 32. This trip unit includes a heater 33 and a terminal 34 which are the main circuitry conductor portion, a terminal screw 35, a bimetal tripping device and an instant tripping device that are provided for each pole. This trip unit also includes a rotatable trip shaft 36 and a latch shaft 37 provided common to the three poles.

The bimetal tripping device includes a bimetal 38 attached at the root to the reverse U-shaped flexion of heater 33 as shown in FIG. 1. This bimetal trip device has bimetal 38 gradually curved leftwards by the Joule heat generated at heater 33 when overcurrent flows. At an elapse of a predetermined time, the leading end of bimetal 38 presses a pin 39 attached at an arm 36*a* of trip shaft 36, whereby trip shaft 36 urged clockwise by a spring not shown is rotated counterclockwise.

The instant tripping device includes a fixed core 40 attached to heater 33, a movable core 42 provided rotatably to shaft 41 and bent in an angulated U-shaped manner, and a spring 43 that urges movable core 42 counterclockwise, as shown in FIG. 1. When a current generating an electromagnetic attraction exceeding the urging force of spring 43 flows to heater 33, movable core 42 instantly rotates clockwise. The leading end of movable core 42 pushes a lower arm 36*b* of trip shaft 36, whereby trip shaft 36 rotates counterclockwise.

Latch shaft 37 includes a latch arm 37*a*, a switch mechanism trip arm 37*b*, two trip set arms 37*c* and a tripping device reset arm 37*d*. Latch shaft 37 is urged counterclockwise in FIG. 1 by spring 44. Latch arm 37*a* engages latch reception 36*c* provided at trip shaft 36, whereby the rotation of latch arm 37*a* is blocked. A reset lever 45 is provided in a rotatable manner by a shaft 46 at a front wall 32*a* of trip unit casing 32. The notch portion of reset lever 45 is arranged to engage with a pin provided at latch shaft 37 in an eccentric manner. Therefore, reset lever 45 and latch shaft 37 are arranged so that, when one thereof rotates, the other will also rotate.

Figure 16:
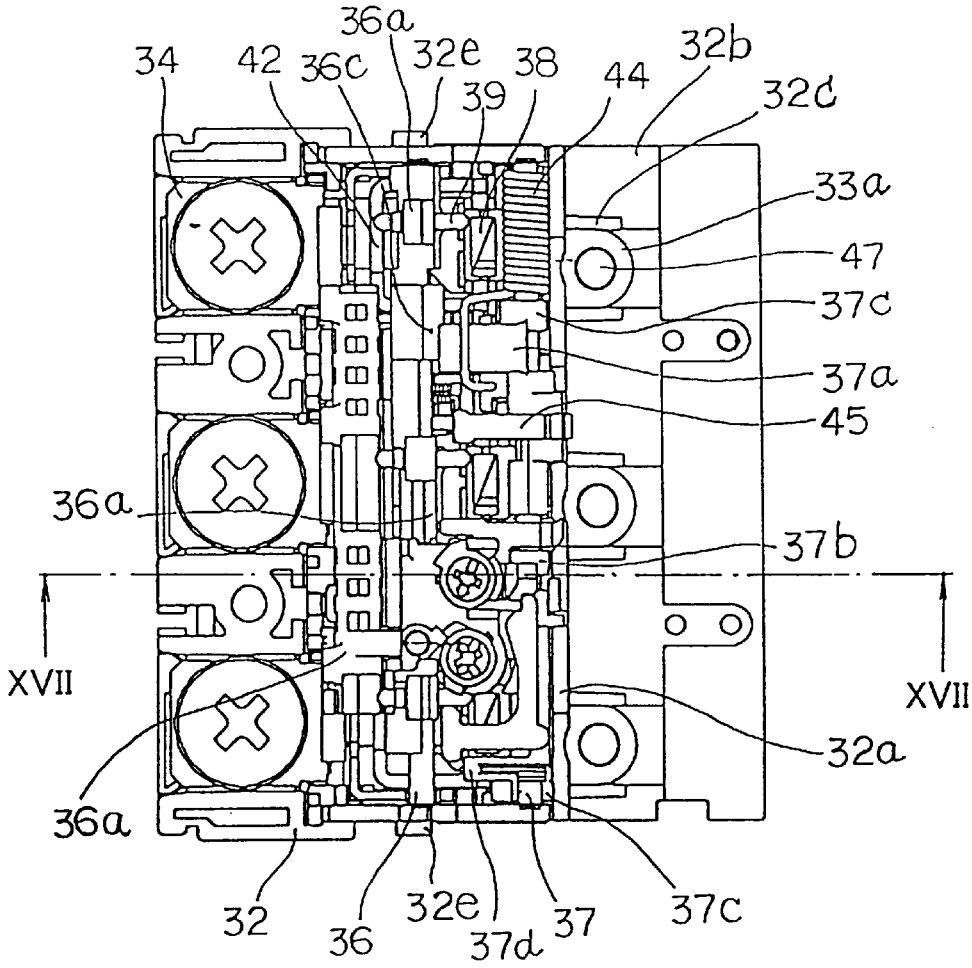
FIG. 16 is a plan view of the circuit breaker of FIG. 15.
Figure 17:
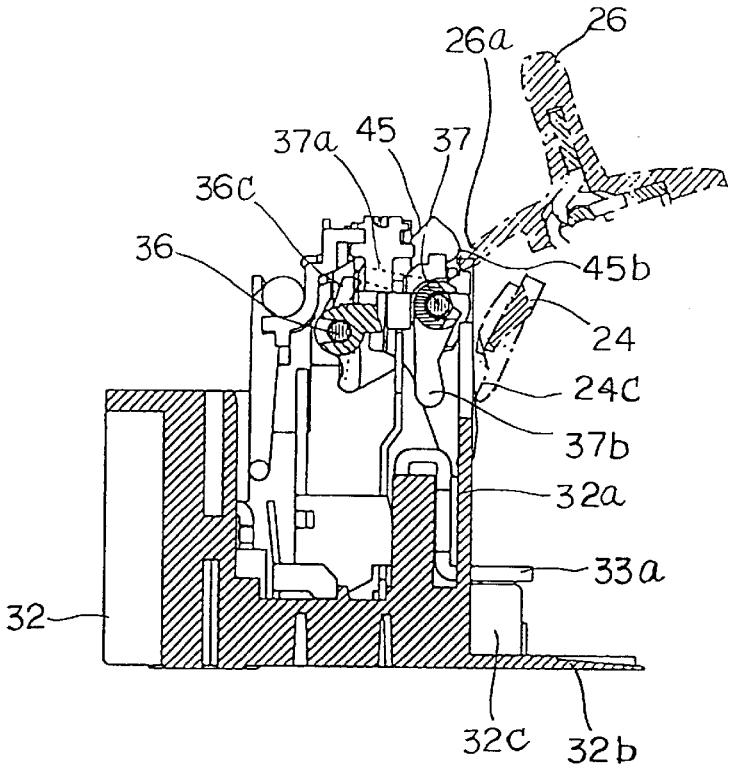
FIGS. 17 is a sectional view of FIG. 16 taken along line XVII—XVII and FIG. 18 are side sectional views of the circuit breaker of FIG. 15.
Figure 18:
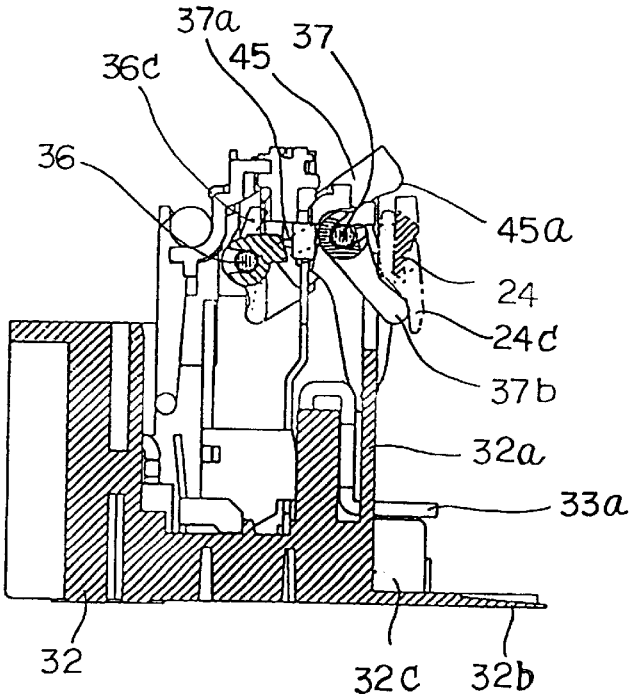

The operation of the trip unit will be described hereinafter. FIG. 17 is a sectional view of the trip unit taken along line XVII—XVII of FIG. 16 showing an untripping state. FIG. 18 shows the trip unit in a tripping state.

When the instant tripping device or bimetal tripping device operates to cause trip shaft 36 to rotate counterclockwise, the engagement between latch arm 37*a* and latch reception 36*c* is canceled. Therefore, latch shaft 37 rotates counterclockwise. The leading end of trip arm 37*b* protrudes out from front wall 32*a* of trip unit casing 32 and reset lever 45 rotates clockwise.

The reset operation of the trip unit is realized by rotating reset lever 45 counterclockwise manually against the force of spring 44. This rotation causes latch shaft 37 to rotate clockwise. When reset lever 45 is made free after latch arm 37*a* and latch reception 36*c* attain an engageable state, latch shaft 37 rotates counterclockwise. As a result, a reset state where latch arm 37*a* and latch reception 36*c* engage is established.

As described above, the circuit breaker independently enables itself to make the operation of the instant tripping device or bimetal tripping device adjusted and confirmed without connecting with the switch unit.

The coupling of the switch unit and the trip unit configured as described above will be set forth hereinafter with reference to FIGS. 1–4, 19, 20A, and 20B. Trip unit casing 32 is formed with a plane portion 32*b* having an inclined leading end, and a U-shaped block portion 32*c* provided at plane portion 32*b* for each pole. An end portion 33*a* of heater 33 is located at the upper end portion of block portion 32*c*. A hexagon socket screw 47 is inserted between the legs of block portion 32*c* and between end portion 33*a* of heater 33 and plane portion 32*b*. A small through hole 32*d* for the passage of a tool to turn screw 47 is formed in plane portion 32*b*.

The switch unit and the trip unit are coupled so that end portion 33*a* of heater 33 and lead terminal 14 overlap, and the inclining surface of plane portion 32*b* and the inclining surface at the left side of the bottom of arc extinguisher casing 1 overlap. Then, screw 47 is turned around from the bottom to securely fasten lead terminal 14 and end portion 33*a* with nut 16.

Figure 19:
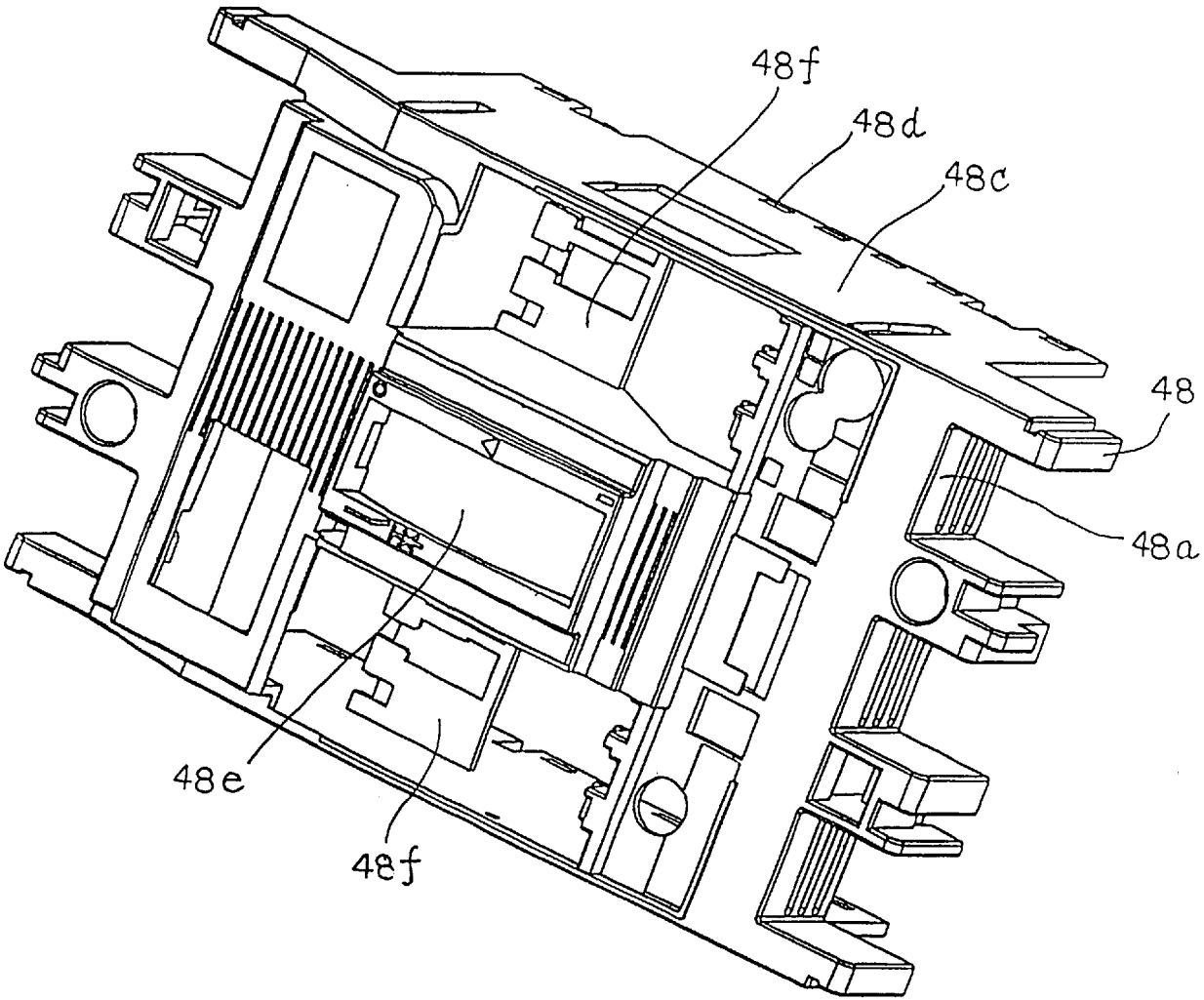
FIG. 19 is a perspective view of the cover.
Figure 20A:
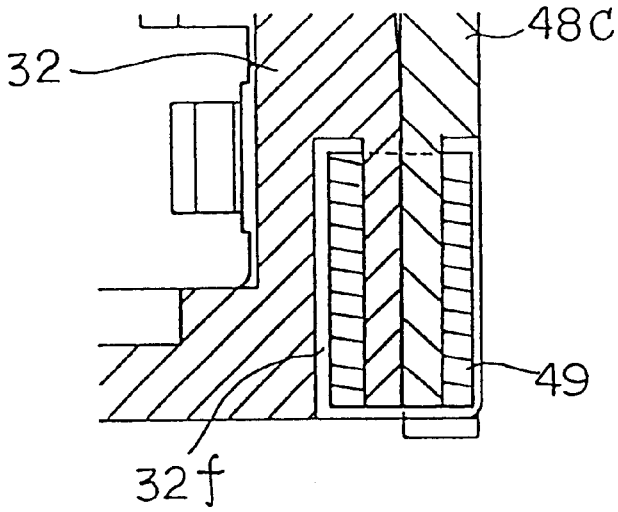
FIG. 20A is a partial sectional view of FIG. 3 taken along line XXA—XXA.
Figure 20B:
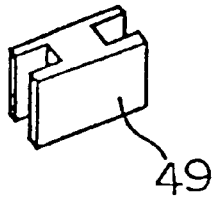
FIG. 20B is a diagram to describe a fixture of the cover.

The units coupled as described above are covered with a mold insulative cover 48 shown in FIG. 19. The coupling between the units is strengthened by the wall extending vertically from the four sides of the front portion of the cover. Specifically, as shown in FIG. 1, a vertical wall 48*a* located at the right side of cover 48 extends in the direction of terminal portion 3*a* along wall 10*b* of terminal base 10 in close contact, and vertical wall 48*b* at the left side of cover 48 extends in the direction of terminal 34 along the edge of the sidewall of trip unit casing 32 in close contact. Thus, the coupling in the left and right directions is enhanced. Furthermore, as shown in FIGS. 1, 3, 5, 19, 20A, and 20B, a sidewall 48*c* extends from both side ends of the front portion of cover 48 along the sidewalls of trip unit casing 32 and arc extinguisher casing 1 in close contact. Cover 48 is also secured by engaging a plurality of rectangular holes 48*d* formed at the lower edge portion of sidewall 48c with a plurality of projections 1*h* of arc extinguisher casing 1 and a projection 32*e* of trip unit casing 32. Thus, the circuit breaker shown in FIG. 3 is enhanced in the width direction of the circuit breaker as well as the horizontal and vertical directions. Since sidewall 48*c* of cover 48 is formed relatively thin and has elasticity, the above engaging process can be carried out easily and will not be readily disengaged. However, for the sake of ensuring the fixation, a fixture 49 is provided, as shown in FIG. 3 and FIG. 20A which is a cross section taken along line XXA—XXA of FIG. 3. Fixture 49 has an H-shaped cross section shown in the perspective view of FIG. 20B. This fixing bracket 49 is attached so as to sandwich the slit portion formed at the lower edge of sidewall 48*c* of cover 48 and the outer walls of a groove 32*f* where a slit is formed at the outer wall of trip unit casing 32. A similar fixing bracket is provided between cover 48 and arc extinguisher casing 1.

An opening 48*e* is formed at the front of cover 48 at the middle pole portion through which handle 26 protrudes outwards. Also, a dent 48*f* is formed at the side pole portion to accommodate internal accessories. An auxiliary cover 50 covering dent 48*f* that can be opened/closed by a hinge as shown by the chain dotted line in FIG. 3 is provided at cover 48.

The manipulation and operation of the circuit breaker coupled as described above are set forth below. The opening operation and closing operation are similar to those carried out by the switch unit alone described above. Therefore, description thereof will not be repeated.

Figure 15:
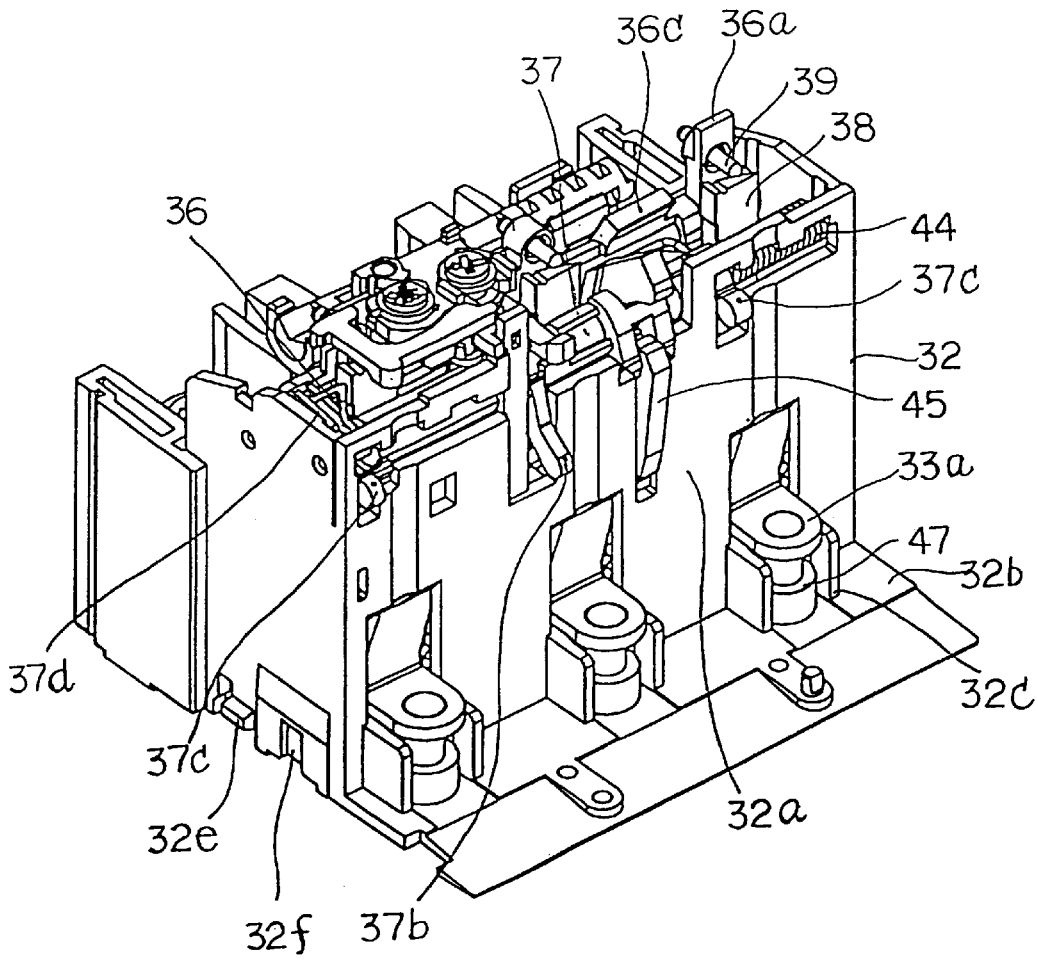
FIG. 15 is a perspective view of the appearance of the trip unit of the circuit breaker of FIG. 1.

When the trip unit is operated by the bimetal tripping device or instant tripping device, the switching mechanism trip arm 37*b* of latch shaft 37 protrudes from front wall 32*a* of trip unit casing 32, as shown in FIG. 15. Latch 24 that is the member of the switch unit in direct relation with the trip unit is indicated in FIGS. 17 and 18 in a chain dotted line. A trip arm 24*c* of latch 24 is urged by switch mechanism trip arm 37*b*, whereby latch 24 rotates counterclockwise to trip the switch unit.

The reset operation is effected by rotating handle 26 in a trip state counterclockwise, as indicated by the chain dotted line in FIG. 18. In response to this operation, left end 26*a* of handle 26 pushes reset edge 45*a* of reset lever 45, whereby reset lever 45 is rotated counterclockwise to attain a resettable state. At this stage, handle 26 is set free, whereby the trip unit is reset together with the switch unit described previously.

With regards to the circuit breaker of the present invention, a plurality of types of trip units interchangeable according to the current capacity and a switch unit common to each trip unit are kept in stock separately. The circuit breaker of the present embodiment can be completed by coupling the trip unit and the switch unit according to a customer's order. The exchange of a trip unit in a circuit breaker completed as a product can be readily carried out. Specifically, screw 47 is loosened, and fixture 49 of the trip unit is removed. Engagement between rectangular hole 48*d* of cover 48 and projection 32*e* of trip unit casing 32 is canceled. The trip unit is detached from the switch unit. Then, a new trip unit is to be mounted in an order opposite to that described above.

Figure 21B:
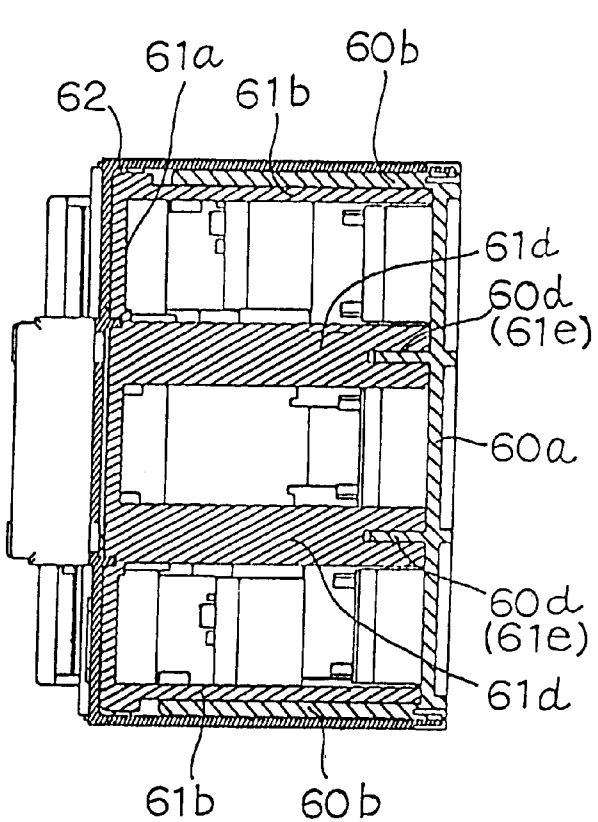
FIG. 21B is a sectional view of FIG. 21A taken along line XXIB—XXIB.
Figure 21A:
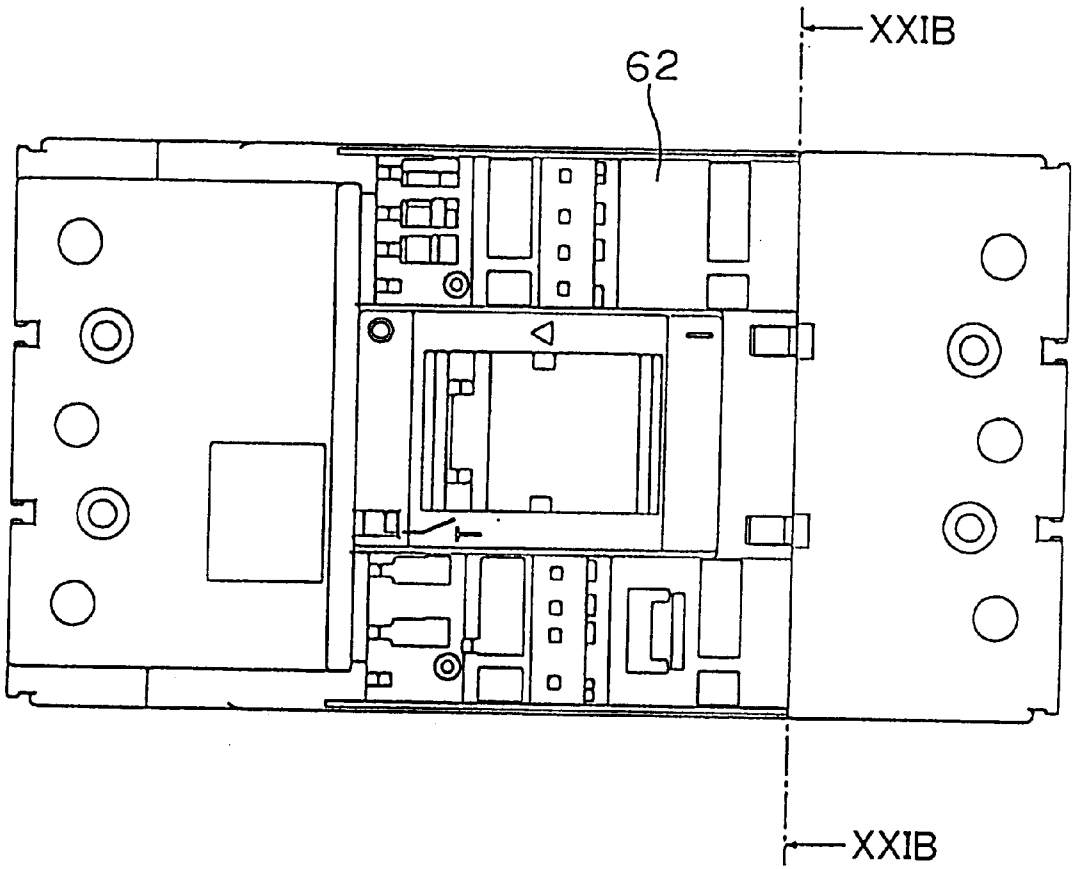
FIGS. 21A and 22 are diagrams to describe an arc extinguisher casing according to other embodiments of the present invention.
Figure 22:
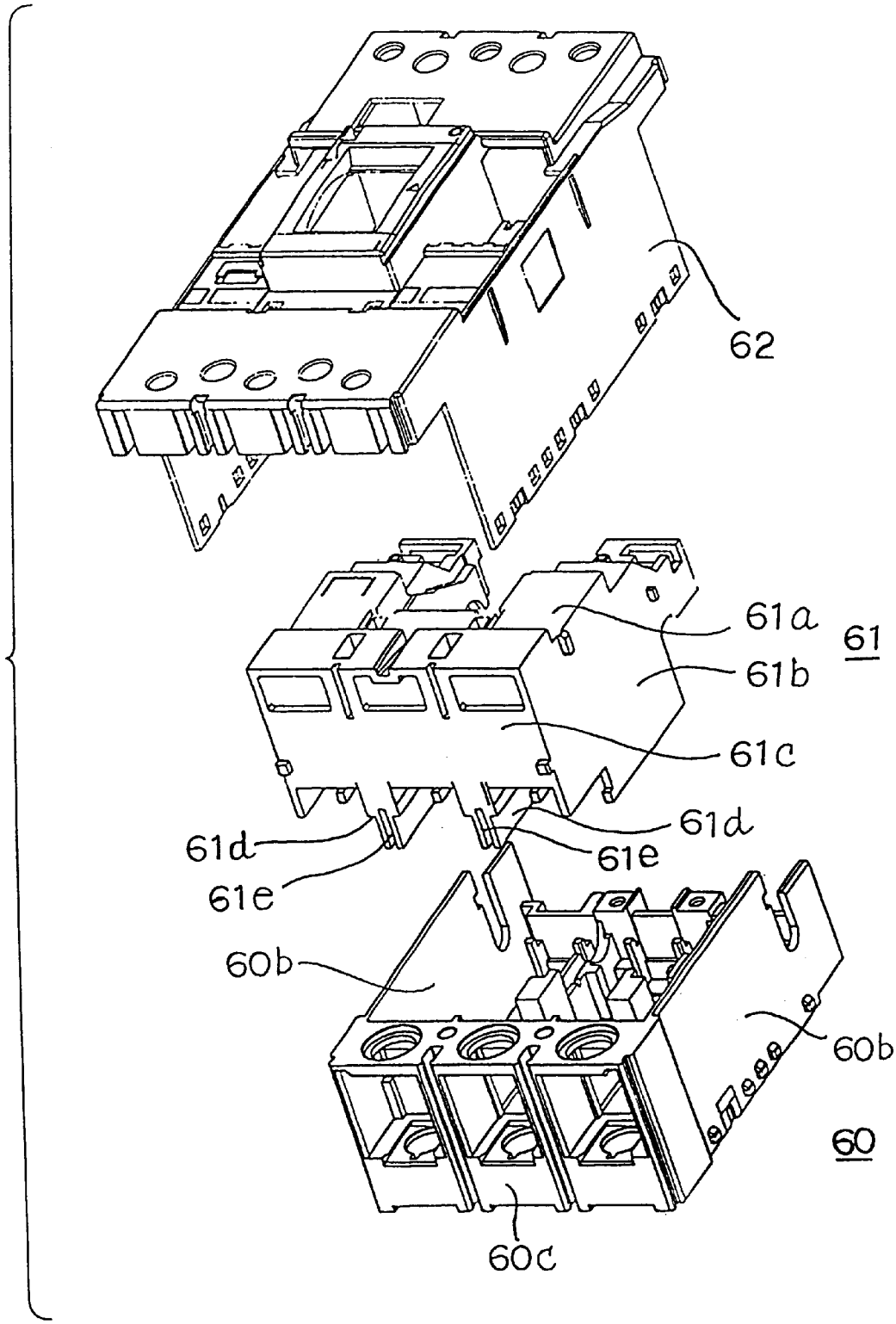
Figure 23:
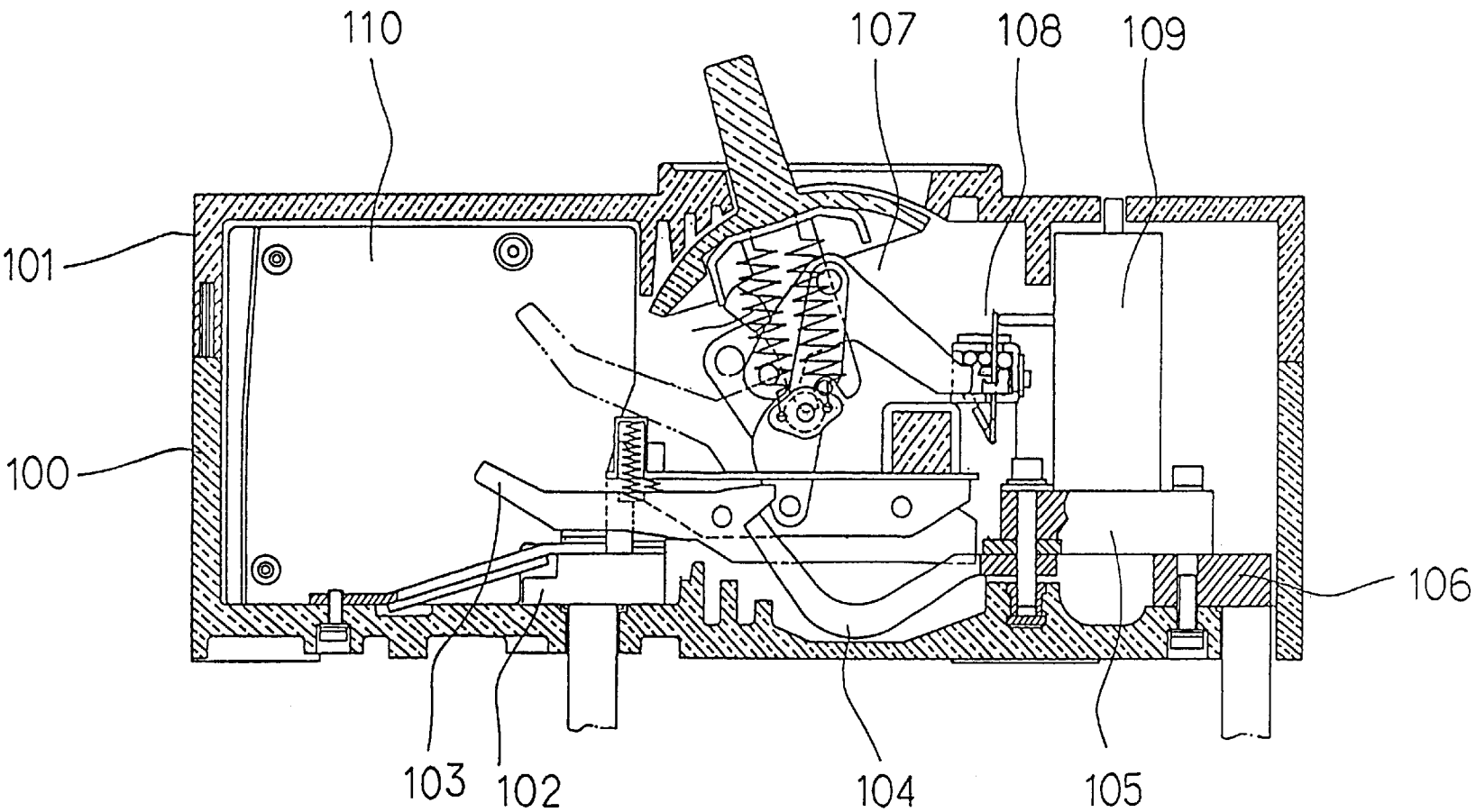
FIG. 23 PRIOR ART
FIG. 23 is a side sectional view of a conventional multipolar circuit breaker.

In contrast to the arc extinguisher casing having the bottom, the ceiling, both sidewalls and the partition walls formed integrally as in the above-described embodiment, the object of the present invention can be achieved even with an arc extinguisher casing including an upper side member and a lower side member that can be divided into upper and lower parts, as shown in FIGS. 21A, 21B, and 22. FIG. 21A is a front view with the upper side member and the lower side member coupled, and FIG. 21B is a sectional view taken along line XXIB—XXIB of FIG. 21A. FIG. 22 is an exploded perspective view of this combination. The arc extinguisher casing is formed of a synthetic resin mold insulative lower member 60 and upper member 61. Lower member 60 includes a bottom 60*a*, sidewalls 60*b*, and an auxiliary partition wall 60*d* upright from bottom 60*a*, at a portion corresponding to the partition wall between the poles. Upper member 61 includes a ceiling 61*a*, sidewalls 61*b*, a wall 60*c* with a vent hole, a partition wall 61*d*, and a groove 61*e* formed in partition wall 61*d*. This arc extinguisher casing is arranged so that sidewall 61*b* of upper member 61 is in close contact at the inner side of sidewall 61*b* of lower member 60, and that groove 61*e* of sidewall 61*b* of upper member 61 engages auxiliary partition wall 60*d* of lower member 60. The overlap of the sidewalls of the upper member and the lower member prevents arc gas from blowing out from the side in such an arc extinguisher casing. Furthermore, the overlap between the partition wall between the poles and the auxiliary partition wall prevents arc gas from flowing into the adjacent pole. Likewise the previous embodiment, a synthetic resin mold insulative cover 62 can be mounted to the arc extinguisher casing arranged as described above.

Although the present invention has been described and illustrated in detail, it is clearly understood that the same is by way of illustration and example only and is not to be taken by way of limitation, the spirit and scope of the present invention.

What is claimed is:

1. A multipolar circuit breaker including a switch contact, an arc extinguisher, an input terminal, an output terminal, and an overcurrent tripping device for each pole, and including in common to each pole a switch mechanism operating said switch contact, and a trip mechanism opening said switch contact through said switch mechanism when said overcurrent tripping device is operated, wherein said multipolar circuit breaker comprises an arc extinguisher casing having a ceiling portion, a bottom portion, and a sidewall connecting said ceiling portion and said bottom portion and formed in continuity so that no gap is formed by an outward internal pressure, and said switch contact and said arc extinguisher are stored so that the switch contact and the arc extinguisher for each pole are separated from the counterpart of a neighbor pole by a partition wall parallel to said sidewall of said arc extinguisher casing and separating each pole.

2. The multipolar circuit breaker according to claim 1, wherein a portion of said arc extinguisher casing including at least said ceiling portion, said bottom portion and said sidewall is formed in one piece by integralmolding.

3. The multipolar circuit breaker according to any of claim 2, wherein said switch mechanism is provided on an outer face of said arc extinguisher casing.

4. The multipolar circuit breaker according to claim 3, said multipolar circuit breaker comprising a switch unit including said switch contact, said arc extinguisher, said arc extinguisher casing and said switch mechanism, a trip unit storing said overcurrent tripping device in a synthetic resin mold insulative trip unit casing, and a synthetic resin mold insulative cover enclosing said switch unit and said trip unit.

5. The multipolar circuit breaker according to claim 4, wherein said synthetic resin mold insulative cover comprises a ceiling portion of substantially a rectangular outer shape when viewed in plan, and a sidewall extending from four sides of said ceiling portion and being in close contact with said arc extinguisher casing and said trip unit casing in parallel.

6. The multipolar circuit breaker according to claim 5, wherein any one of a convex portion and a concave portion which are both engageable with the other counterpart is formed at respective sidewalls of said arc extinguisher casing and said trip unit casing, a and the other engageable counterparts of said convex portion or concave portion are formed at least one pair of opposite-facing sidewalls of said synthetic resin mold insulative cover, so that said convex portion and said concave portion are engaged.

7. The multipolar circuit breaker according to claim 4, wherein a connection portion of a main circuit conductor portion included in said switch unit and said trip unit includes a screw that is to be screwed from a back side of said circuit breaker.

8. The multipolar circuit breaker according to claim 1, wherein said arc extinguisher casing includes an upper member having said ceiling portion and a portion of said sidewall located at the ceiling side formed in one piece by integral-molding, and a lower member having said bottom portion and a portion of said sidewall located at the bottom side formed in one piece by integral-molding, said portion of said sidewall of said upper member and said portion of the sidewall of the lower member being overlapped.

9. The multipolar circuit breaker according to any of claim 3, wherein said switch mechanism is provided on an outer face of said arc extinguisher casing.

10. The multipolar circuit breaker according to claim 9, said multipolar circuit breaker comprising a switch unit including said switch contact, said arc extinguisher, said arc extinguisher casing and said switch mechanism, a trip unit storing said overcurrent tripping device in a synthetic resin mold insulative trip unit casing, and a synthetic resin mold insulative cover enclosing said switch unit and said trip unit.

11. The multipolar circuit breaker according to claim 10, wherein said synthetic resin mold insulative cover comprises a ceiling portion o f substantially a rectangular outer shape when viewed in plan, and a sidewall extending from four sides of said ceiling portion and being in close contact with said arc extinguisher casing and said trip unit casing in parallel.

12. The multipolar circuit breaker according to claim 11, wherein any one of a convex portion and a concave portion which are both engageable with the other counterpart is formed at respective sidewalls of said arc extinguisher casing and said trip unit casing, and the other engageable counterparts of said convex portion or concave portion are formed at least one pair of opposite-facing sidewalls of said synthetic resin mold insulative cover, so that said convex portion and said concave portion are engaged.

13. The multipolar circuit breaker according to claim 10, wherein a connection portion of a main circuit conductor portion included in said switch unit and said trip unit includes a screw that is to be screwed from a back side of said circuit breaker.

14. The multipolar circuit breaker according to any of claim 1, wherein said switch mechanism is provided on an outer face of said arc extinguisher casing.

15. The multipolar circuit breaker according to claim 14, said multipolar circuit breaker comprising a switch unit including said switch contact, said arc extinguisher, said arc extinguisher casing and said switch mechanism, a trip unit storing said overcurrent tripping device in a synthetic resin mold insulative trip unit casing, and a synthetic resin mold insulative cover enclosing said switch unit and said trip unit.

16. The multipolar circuit breaker according to claim 15, wherein said synthetic resin mold insulative cover comprises a ceiling portion of substantially a rectangular outer shape when viewed in plan, and a sidewall extending from four sides of said ceiling portion and being in close contact with said arc extinguisher casing and said trip unit casing in parallel.

17. The multipolar circuit breaker according to claim 16, wherein any one of a convex portion and a concave portion which are both engageable with the other counterpart is formed at respective sidewalls of said arc extinguisher casing and said trip unit casing, and the other engageable counterparts of said convex portion or concave portion are formed at least one pair of opposite-facing sidewalls of said synthetic resin mold insulative cover, so that said convex portion and said concave portion are engaged.

18. The multipolar circuit breaker according to claim 15, wherein a connection portion of a main circuit conductor portion included in said switch unit and said trip unit includes a screw that is to be screwed from a back side of said circuit breaker.

* * * * *